US009757950B2

(12) United States Patent
Nie et al.

(10) Patent No.: US 9,757,950 B2
(45) Date of Patent: Sep. 12, 2017

(54) INK CARTRIDGE, INK CARTRIDGE ASSEMBLY AND METHOD FOR DETECTING THE INSTALLATION OF INK CARTRIDGE

(71) Applicant: ZHUHAI NINESTAR MANAGEMENT CO., LTD., Zhuhai (CN)

(72) Inventors: Bing Nie, Zhuhai (CN); Zhizheng Jia, Shanghai (CN); Yuedan Liang, Zhuhai (CN)

(73) Assignee: ZHUHAI NINESTAR MANAGEMENT CO., LTD., Zhuhai (CN)

( * ) Notice: Subject to any disclaimer, the term of this patent is extended or adjusted under 35 U.S.C. 154(b) by 0 days.

(21) Appl. No.: 15/368,511

(22) Filed: Dec. 2, 2016

(65) Prior Publication Data

US 2017/0080717 A1 Mar. 23, 2017

Related U.S. Application Data

(63) Continuation of application No. 14/312,494, filed on Jun. 23, 2014, now Pat. No. 9,545,795, which is a (Continued)

(30) Foreign Application Priority Data

Dec. 30, 2011 (CN) ..... 2011 1 0459870
Dec. 30, 2011 (CN) ..... 2011 1 0460180

(51) Int. Cl.
*B41J 2/165* (2006.01)
*B41J 2/175* (2006.01)

(52) U.S. Cl.
CPC ..... *B41J 2/17543* (2013.01); *B41J 2/1752* (2013.01); *B41J 2/1753* (2013.01); *B41J 2/17546* (2013.01)

(58) Field of Classification Search
None
See application file for complete search history.

(56) References Cited

U.S. PATENT DOCUMENTS

2005/0185034 A1 8/2005 Anma et al.
2006/0244795 A1 11/2006 Hayasaki et al.
2010/0141715 A1 6/2010 Swartz et al.

FOREIGN PATENT DOCUMENTS

CN 2810982 Y 8/2006
CN 101683788 A 3/2010
(Continued)

*Primary Examiner* — Alejandro Valencia
(74) *Attorney, Agent, or Firm* — Anova Law Group, PLLC

(57) ABSTRACT

The present invention relates to an ink cartridge, an ink cartridge assembly and a method for detecting the installation of the ink cartridge. A plurality of ink cartridges are detachably mounted on an inkjet printer including a light receiver and a plurality of apparatus electrical contacts which are commonly connected with a line, the ink cartridge comprises a container electrical contact electrically connected with corresponding apparatus electrical contact an information storage device, a light-emitting portion configured to emit light towards the light receiver, and a control portion configured to control the light-emitting portion to emit light, wherein, the control portion of the ink cartridge controls the light-emitting portion to emit light when receiving an emission instruction sent by the inkjet printer. Therefore, the stability of the ink cartridge installation detection can be fully guaranteed and the phenomenon of installation detection error can be avoided.

10 Claims, 12 Drawing Sheets

Related U.S. Application Data continuation of application No. PCT/CN2012/087425, filed on Dec. 25, 2012.

(56) References Cited

FOREIGN PATENT DOCUMENTS

| | | | |
|---|---|---|---|
| CN | 201645986 | U | 11/2010 |
| CN | 102145585 | A | 8/2011 |
| CN | 102173209 | A | 9/2011 |
| CN | 102189787 | A | 9/2011 |
| CN | 102230598 | A | 11/2011 |
| EP | 1547781 | A2 | 6/2005 |
| EP | 2482182 | A1 | 8/2012 |
| JP | 2007001033 | A | 1/2007 |
| JP | 2009006680 | A | 1/2009 |
| JP | 2011194608 | A | 10/2011 |

| | | | | | | |
|---|---|---|---|---|---|---|
| K ON | 1 | 1 | 0 | 0 | 0 | 0 |
| K OFF | 1 | 1 | 0 | 1 | 0 | 0 |
| Y ON | 1 | 0 | 1 | 0 | 0 | 0 |
| Y OFF | 1 | 0 | 1 | 1 | 0 | 0 |

FIG. 3a

| | | | | | | |
|---|---|---|---|---|---|---|
| ON | X | X | X | 0 | 0 | 0 |
| OFF | X | X | X | 1 | 0 | 0 |

FIG. 3b

INK CARTRIDGE, INK CARTRIDGE ASSEMBLY AND METHOD FOR DETECTING THE INSTALLATION OF INK CARTRIDGE

CROSS REFERENCE TO RELATED APPLICATIONS

This application is a continuation of U.S. patent application Ser. No. 14/312,494, filed on Jun. 23, 2014, which is a continuation of International Application No. PCT/CN2012/087425, filed on Dec. 25, 2012, which claims priority to China Patent Application No. 201110460180.8, 201110459870.1, respectively filed with the Chinese Patent Office, on Dec. 30, 2011, entitled "INK CARTRIDGE, INK CARTRIDGE ASSEMBLY, INKJET RECORDING DEVICE, MODULE AND METHOD FOR DETECTING THE INSTALLATION OF INK CARTRIDGE" and "INKJET CARTRIDGE ASSEMBLY AND METHOD FOR DETECTING THE INSTALLATION OF THE SAME, both of which are hereby incorporated herein by reference in their entireties.

FIELD OF THE TECHNOLOGY

The present invention relates to the inkjet technical field of inkjet recording apparatuses, in particular to an ink cartridge and an ink cartridge assembly detachably mounted on a color inkjet recording apparatus, and a method for detecting the installation of the ink cartridge.

BACKGROUND

A color inkjet printer is provided with an ink cartridge assembly as required. Ink of different colors is refilled into different ink cartridges, and all the ink cartridges are mounted on the printer. In order to ensure the normal printing of the inkjet printer and avoid the print error caused by the fact that the ink cartridge is mounted at a wrong position, generally, whether the ink cartridge is correctly mounted at an appropriate position in the inkjet printer must be detected in the process of ink cartridge installation. FIG. 1 is a schematic diagram illustrating the ink cartridge installation detection in the prior art. As illustrated in FIG. 1, supposing the inkjet printer is provided with four ink cartridges, each ink cartridge is respectively mounted at corresponding ink cartridge mounting position; a correct position corresponding to the ink cartridge a is a position A; a correct position corresponding to the ink cartridge b is a position B; a correct position corresponding to the ink cartridge c is a position C; and a correct position corresponding to the ink cartridge d is a position D.

An ink cartridge chip is provided with a light-emitting portion, e.g., a light-emitting diode (LED) lamp; and a light receiving portion capable of receiving light emitted by the light-emitting portion is disposed on a housing of the inkjet printer. The light-emitting portion of the detected ink cartridge will be turned on; the light receiving portion corresponds to a correct position at which the ink cartridge must be disposed; if the light receiving portion can receive light with light quantity reaching a default threshold at the position, it indicates that the detected ink cartridge has been correctly mounted; and if the light quantity does not reach the default threshold, it indicates that the ink cartridge is not mounted at the correct position and an installation error will be prompted. For instance, as illustrated in FIG. 1, when the ink cartridge b is detected, the light-emitting portion on the ink cartridge b is turned on and emits light, and the light receiving portion corresponds to the correct position B at which the ink cartridge b must be disposed; and if the light receiving portion can receive light with light quantity reaching the default threshold at the position, it indicates that the ink cartridge b has been mounted at the correct position. Subsequently, the ink cartridges a to d are integrally driven by a carriage in the inkjet printer to move along an arrowhead direction as shown in FIG. 1; the light receiving portion corresponds to the position C and the ink cartridge c is turned on; and whether the ink cartridge c is correctly mounted is detected by the above method. The process is continued until all the ink cartridges are detected.

However, in the actual detection process, the case that the ink cartridge is mounted at the correct position but is determined to be not mounted at the correct or appropriate position as the light receiving portion does not receive the light with enough light quantity will usually occur. In the final analysis, the root cause of the above problem is that: in the actual production process, due to unavoidable manufacturing error, the light quantity of light emitted by each LED lamp has difference. Therefore, when the light quantity of the light emitted by the LED lamp of the detected ink cartridge is small, as the emitted light is scattered light, the phenomenon that the light quantity of the light arriving at the light receiving portion does not reach the threshold and hence the light receiving portion determines that the ink cartridge is not mounted even if the ink cartridge has been correctly mounted in place tends to occur.

Moreover, from the viewpoint of the inkjet printer, the inkjet printer can only be adapted to specific ink cartridges and cannot be adapted to non-specific ink cartridges which are not provided with LED lamps and cannot respond to on instructions and the like, and hence the ink cartridge selection range of users can be limited and the use cost of the users can be increased. But from the viewpoint of the specific ink cartridges, the production cost of the specific ink cartridges is relatively high. Moreover, due to the limitation of the factors such as the settings of the LED lamps and the self functions of the chips, the specific ink cartridges are likely to become disposable products, namely the specific ink cartridges will be discarded after used up. Therefore, not only the use cost of the users can be increased but also recyclable resources such as the LED lamps can be wasted due to the discarding of the specific ink cartridges; and the environmental pollution can be easily caused.

SUMMARY

The objective of the present invention is to provide an ink cartridge, an ink cartridge assembly and a method for detecting the installation of the ink cartridge, which can solve the problem that the light quantity of light received by a light receiver cannot reach a threshold without changing the structure of the ink cartridge and can also improve the universality of the ink cartridge.

In order to solve the technical problem, the present invention adopts the technical proposal that:

The present invention relates to an ink cartridge, the plurality of ink cartridges detachably mounted on an inkjet printer, wherein the inkjet printer includes a light receiver for receiving light and a plurality of apparatus electrical contacts which are commonly connected with a line, wherein the ink cartridge comprises a container electrical contact electrically connected with corresponding apparatus electrical contact, an information storage device configured to at least store relevant information of the ink cartridge, a light-emitting portion configured to emit light towards the light receiver, and a control portion configured to control the light-emitting portion to emit light according to an emission instruction send by the inkjet printer for controlling the light-emitting portion to emit light, characterized in that the control portion of the ink cartridge controls the light-emitting portion to emit light when receiving the emission instruction sent by the inkjet printer for controlling any light-emitting portion of the plurality of ink cartridges to emit light.

The emission instruction includes ink cartridge identifying information and state control information of the light-emitting portion.

The information storage device is configured to store ink cartridge identifying information.

The ink cartridge further comprises an ink cartridge chip; and both the container electrical contact and the information storage device are disposed on the ink cartridge chip.

The control portion of the ink cartridge controls the light-emitting portion to emit light when receiving the emission instruction sent by the inkjet printer for controlling any light-emitting portion of the plurality of ink cartridges to emit light, more specifically: when the control portion receives the emission instruction from the inkjet printer, the control portion only controls the light-emitting portion according to the state control information of the light-emitting portion included in the emission instruction but ignores the ink cartridge identifying information included in the emission instruction.

The ink cartridge is provided with an ink cartridge installation detection module which includes a light-emitting portion and a control portion and is configured to receive a plurality of emission instructions sent by the inkjet printer via a line, analyze the plurality of emission instructions, and turn on or off the light-emitting portion according to the analytic result.

The ink cartridge installation detection module is also provided with a storage unit for storing the quantity of ink cartridge identifying information.

The control portion of the ink cartridge controls the light-emitting portion to emit light when receiving the emission instruction sent by the inkjet printer for controlling any light-emitting portion of the plurality of ink cartridges to emit light, more specifically: when the control portion receives the emission instruction from the inkjet printer, the control portion acquires the ink cartridge identifying information and the state control information of the light-emitting portion included in the emission instruction, compares the emission instruction with the quantity of ink cartridge identifying information stored in the storage unit, and turns on or off the light-emitting portion according to the emission instruction when the quantity of ink cartridge identifying information include the ink cartridge identifying information included in the emission instruction.

The ink cartridge installation detection module and the ink cartridge chip are integrated into a whole.

The present invention relates to an ink cartridge assembly, which comprises the plurality of ink cartridges according to claim 1, wherein the control portion of each ink cartridge in the ink cartridge assembly respectively controls the light-emitting portion of each ink cartridge to emit light when receiving an emission instruction sent by the inkjet printer for controlling any light-emitting portion of the ink cartridge assembly to emit light.

The control portion of the ink cartridge includes an information read-write control unit and an emission control unit; the information read-write control unit is configured to respond when receiving an installation reply instruction, matched with the ink cartridge identifying information, sent by the inkjet printer; and the emission control unit is configured to control the light-emitting portion to emit light when receiving any emission instruction sent by the inkjet printer.

The control portion of the ink cartridge controls the light-emitting portion to emit light when receiving the emission instruction sent by the inkjet printer for controlling any light-emitting portion of the plurality of ink cartridges to emit light, more specifically: when the control portion receives the emission instruction from the inkjet printer, the control portion only controls the light-emitting portion according to the state control information of the light-emitting portion included in the emission instruction but ignores the ink cartridge identifying information included in the emission instruction.

The present invention relates to a method for detecting the installation of the foregoing ink cartridge, the plurality of ink cartridges detachably mounted on an inkjet printer, the inkjet printer respectively communicated with the plurality of ink cartridges through a plurality of apparatus electrical contacts formed thereon, the plurality of apparatus electrical contacts commonly connected with a line, the inkjet printer also provided with a light receiver for receiving light, the ink cartridge comprising a container electrical contact electrically connected with corresponding apparatus electrical contact, an information storage device configured to at least store relevant information of the ink cartridge, a light-emitting portion configured to emit light towards the light receiver, and a control portion configured to control the light-emitting portion to emit light according to an emission instruction send by the inkjet printer for controlling the light-emitting portion to emit light, wherein the installation detection method comprises the following steps: step 1: the inkjet printer sends a plurality of emission instructions for controlling the light-emitting portions of the plurality of ink cartridges to emit light; and step 2: the control portion of the ink cartridge controls the light-emitting portion to emit light when receiving any emission instruction of the plurality of emission instructions.

The step 2 is specifically as follows: when the control portion receives the emission instruction from the inkjet printer, the control portion only controls the light-emitting portion according to the state control information of the light-emitting portion included in the emission instruction but ignores the ink cartridge identifying information included in the emission instruction.

The step 2 is specifically as follows: a quantity of ink cartridge identifying information are prestored in the ink cartridges; and when the control portion receives the emission instruction from the inkjet printer, the control portion acquires the ink cartridge identifying information and the state control information of the light-emitting portion included in the emission instruction, compares the ink cartridge identifying information included in the emission instruction with the quantity of ink cartridge identifying information, and turns on or off the light-emitting portion according to the emission instruction when the quantity of ink cartridge identifying information include the ink cartridge identifying information included in the emission instruction.

By adoption of the ink cartridge, the ink cartridge assembly and the method for detecting installation of the ink cartridge provided by the present invention, the stability of the ink cartridge installation detection of the printer can be fully guaranteed; the installation detection error caused by the manufacturing error of the light-emitting portion of the ink cartridge can be avoided; the universality of the ink cartridge can be improved; and the selection range of ink cartridges adapted to an inkjet recording apparatus can be widened.

BRIEF DESCRIPTION OF THE DRAWINGS

FIG. 3*a* is a schematic diagram of emission instructions sent by a control circuit of an inkjet printer in the embodiment of the present invention, and FIG. 3*b* is a schematic diagram of emission instructions analyzed by an emission control module of an ink cartridge;

Figure 1:
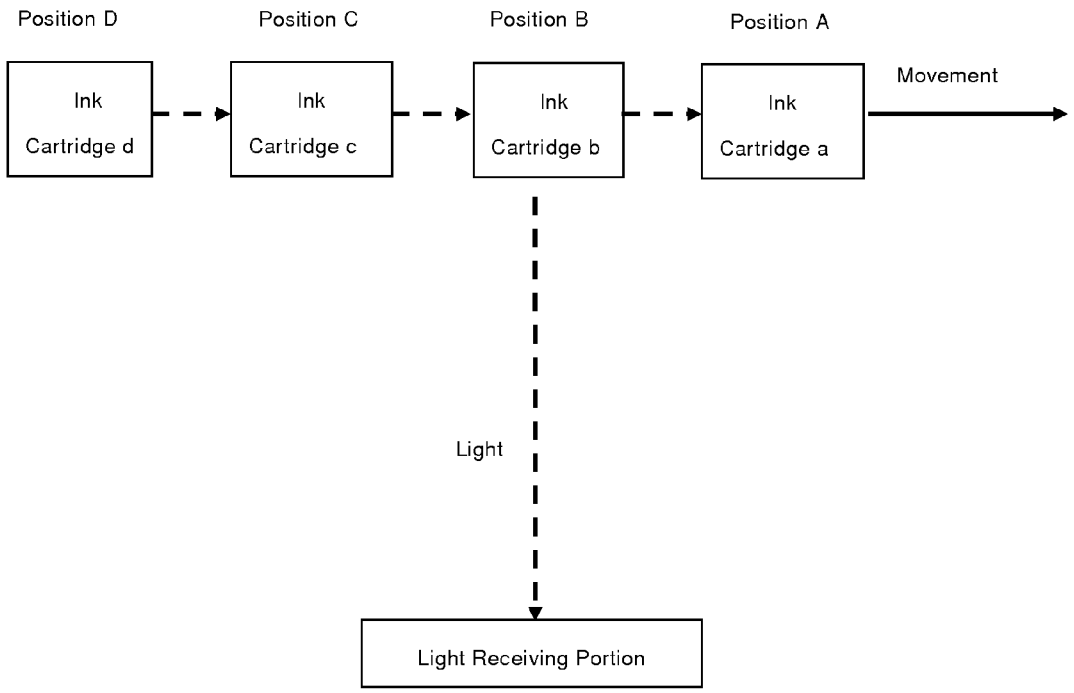
FIG. 1 is a schematic diagram illustrating a method for detecting the installation of an ink cartridge in the prior art.

In the figures, 1-5 ink cartridge, 6 light receiver, 7 electrical conductor, 8 chip, 81 substrate, 82 container electrical contact, 83 memory element, 841 read-write control module, 842 emission control module, 22 ink cartridge installation detection module, A-E ink cartridge accommodating area, 211 housing, 221 light-emitting portion, 84/222 control portion, 2221 receiving unit, 2222 processing unit, 2223 control unit, 2224 storage unit.

DETAILED DESCRIPTION OF EMBODIMENTS

Detailed description will be given below to the present invention with reference to the accompanying drawings and the embodiments.

Complete description will be given to the present invention from two perspectives for more clear understanding of the objective, technical proposal and advantage of the present invention.

Embodiment 1

The present invention mainly relates to an ink cartridge assembly mounted on an inkjet printer, which comprises a plurality of ink cartridges detachably mounted on the inkjet printer. The plurality of ink cartridges refer to two or more ink cartridges.

The inkjet printer, apart from the ink cartridge assembly, also comprises the following components: a carriage, a light receiver and a plurality of apparatus electrical contacts. The carriage can move back and forth in the inkjet printer along the direction which is perpendicular to the paper feed direction; and an ink cartridge mounting portion is also formed on the carriage to mount the ink cartridge assembly. The light receiver is fixed on a housing on one side of the inkjet printer; after the ink cartridge assembly is mounted into the printer, the carriage will drive the plurality of ink cartridges in the ink cartridge assembly to correspond to the light receiver one by one for installation detection; and the light receiver is connected with a control circuit of the inkjet printer to send an electrical signal converted by the received light to the control circuit for judgment. The plurality of apparatus electrical contacts are electrically connected with the control circuit through an electrical conductor 7, namely the plurality of apparatus electrical contacts are commonly connected with a line. That is to say, the plurality of apparatus electrical contacts are connected with each other through a communication line.

Corresponding to the structure of the inkjet printer, each ink cartridge comprises a container electrical contact electrically connected with corresponding apparatus electrical contact, an information storage device configured to at least store relevant information of the ink cartridge, a light-emitting portion configured to emit light towards the light receiver, and a control portion configured to control the light-emitting portion to emit light, wherein the relevant information includes ink cartridge identifying information, and the identifying information of each ink cartridge is different; the control portion includes an information read-write control unit and an emission control unit; the emission control unit is configured to control the light-emitting portion to emit light of the ink cartridge to emit light when receiving an emission instruction sent by the inkjet printer for controlling the light-emitting portion of any ink cartridge in the ink cartridge assembly to emit light; when the information read-write control unit receives an ink cartridge installation reply instruction sent by the inkjet printer, the information read-write control unit will return a reply signal to the printer only when determining that the ink cartridge identifying information in the reply instruction is matched with self identifying information; or else, the information read-write control unit does not respond. In addition, the light-emitting portion not only can emit visible light but also can emit invisible light.

Obviously, as known from the above ink cartridge structure, the control portion of each ink cartridge will control the light-emitting portion to emit light on the ink cartridge to emit light when receiving the instruction sent by the printer for controlling a light-emitting portion on certain ink cartridge to emit light. That is to say, when the printer sends the instruction for controlling the light-emitting portion of certain ink cartridge to emit light each time, the light-emitting portions on all the ink cartridges will be turned on. Therefore, even if the light quantity of light emitted by the light-emitting portion of certain ink cartridge is relatively small, the ink cartridge can also be guaranteed to be correctly identified by the printer under the action of the reinforcement of light of other ink cartridges.

The structure of the ink cartridge and the ink cartridge assembly in the embodiment of the present invention will be described for more clear description of the technical proposal of the present invention.

Figure 2A:
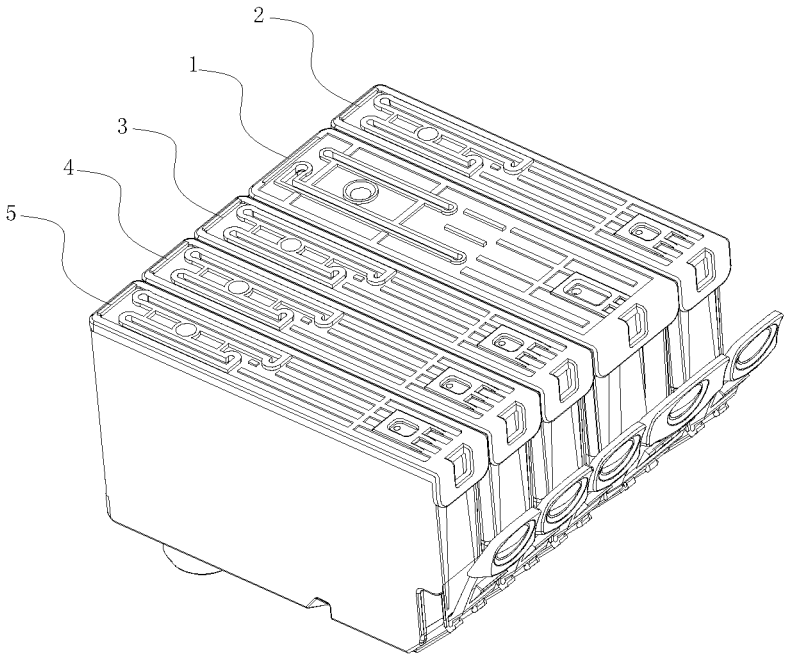
FIG. 2*a* is a schematic outside view of an ink cartridge assembly provided by the embodiment of the present invention.

In the embodiment, the "ink cartridge assembly" refers to a combination of different types of ink cartridges mounted on the same inkjet printer, e.g., different capacities or different colors. FIG. 2*a* is a schematic outside view of the ink cartridge assembly. As illustrated in FIG. 2*a*, the ink cartridge assembly comprises an ink cartridge A1, an ink cartridge B2, an ink cartridge C3, an ink cartridge D4 and an ink cartridge E5. The ink cartridge A is only different from the ink cartridges B, C, D and E in the type of stored ink, but other settings, e.g., the internal structure, are all the same. In the embodiment, the ink cartridges A to E are distinguished by the filled ink. That is to say, the structure description of the ink cartridge A may be applied to the ink cartridges B to E. Therefore, only the structure of the ink cartridge A will be described below in detail, and the detailed description of the ink cartridges B to E will be omitted.

In the embodiment, the ink cartridge assembly is detachably mounted on an inkjet printer. The inkjet printer also comprises the foregoing components such as the carriage, the light receiver 6, the plurality of apparatus electrical contacts and the electrical conductor 7. Moreover, as described above, the plurality of apparatus electrical contacts are electrically connected with a control circuit through the electrical conductor 7, namely the plurality of apparatus electrical contacts are commonly connected with a line and the electrical conductor 7 is equivalent to a line.

Figure 2B:
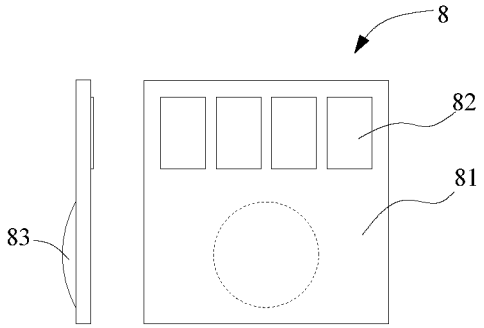
FIG. 2*b* is a schematic structural view of a chip in the embodiment of the present invention.

As illustrated in FIG. 2*b*, in order to guarantee better print quality, the ink cartridge A is also provided with a chip 8, which is configured to store relevant information of the ink cartridge and communicated with the printer. More specifically, a chip substrate 81 is provided with a container electrical contact 82, an information storage device, a light-emitting portion and a control portion 84. The container electrical contact 82 is electrically connected with corresponding apparatus electrical contact in such a way that the ink cartridge is connected with the printer through the apparatus electrical contact. The plurality of apparatus electrical contacts are commonly connected with a line, that is to say, the plurality of ink cartridges respectively connected with the plurality of apparatus electrical contacts through respective container electrical contacts 82 are also commonly connected with a line. Moreover, in the embodiment, the ink cartridge chip is provided with four container electrical contacts respectively corresponding to signals GNd, Vcc, CLK and Data. The information storage device, namely a memory element 83, is configured to store all the independent and relevant information of the ink cartridge a, e.g., including the color information of ink contained in the ink cartridge a. The light-emitting portion is configured to emit light towards the light receiver. More specifically, in the embodiment, the light-emitting portion is an LED lamp. The control portion 84 includes a read-write control module 841 and an emission control module 842 and is configured to control the information storage device or the light-emitting portion according to an instruction sent by the printer.

As illustrated in FIG. 2*a*, in the embodiment, black ink is filled in the ink cartridge A, and color ink, e.g., cyan, magenta ink, etc. is filled in the ink cartridges B, C, D and E. Taking the large consumption of the black ink into account, the size of the ink cartridge A is set to be larger than that of the ink cartridges B, C, D and E. That is to say, the ink cartridge A and the ink cartridges B, C, D and E may be set to have different sizes according to different specific requirements but have same structure and appearance on the whole. It should be understood by those skilled in the art that the size of the ink cartridges A to E may also be set to be same.

The plurality of ink cartridges are connected with the control circuit of the printer through the container electrical contacts, the apparatus electrical contacts and the electrical conductor 7, namely the chips of the plurality of ink cartridges are all commonly connected with a line, that is to say, the plurality of control portions of the ink cartridge assembly are connected with the control circuit through the electrical conductor 7. Therefore, the control portion of each ink cartridge may receive all the instructions sent by the control circuit of the printer, and may receive instruction information sent by the printer to any ink cartridge for controlling the light-emitting portion to emit light. When the printer sends an emission instruction for controlling the light-emitting portion of the ink cartridge B to emit light, the control portions of the ink cartridges A, C, D and E may also receive the emission instruction.

As for the printer, the ink cartridge installation detection process includes two parts: (1) installation determination stage: the printer determines whether all the ink cartridges have been mounted into the printer according to the fact that whether corresponding replies have been received, by sending ink cartridge installation reply instructions in sequence; if so, the printer enters the next stage; or else, the printer prompts a user that the ink cartridge is not completely mounted; and (2) correct installation determination stage: after determining that all the ink cartridges have been completely mounted, the printer controls the plurality of light-emitting portions (LED lamps) by sending emission instructions for controlling the light-emitting portion of each ink cartridge in sequence to emit, so as to determine whether the ink cartridge is mounted at a correct position according to the light quantity of received light. The ink cartridge installation reply instruction is generally composed of identifying information of each ink cartridge, and the emission instruction is generally composed of identifying information of the ink cartridge and state control information of the light-emitting portion. Obviously, the installation reply instruction and the emission instruction are different from each other.

Correspondingly, in the embodiment, each control portion is provided with a read-write control module 841 for controlling the read-write of the chip and an emission control module 842 for controlling the light-emitting portion to emit light. In general, the identifying information of each ink cartridge will be stored in the information storage device of the ink cartridge. Correspondingly, after the ink cartridge assembly is mounted into the printer, when the ink cartridge installation reply instruction is sent by the printer and the identifying information of certain ink cartridge is matched with an identification code sent by the printer, the read-write control module 841 will return a reply signal to the printer, namely respond; at this moment, the printer will determine that the ink cartridge has been mounted; or else, no reply signal is returned to the printer, and the printer will determine that the ink cartridge is not mounted; and when the ink cartridge emission instruction is sent by the printer, the emission control module of the ink cartridge will control the light-emitting portion to emit light on the ink cartridge to emit light.

As described above, the inkjet printer is provided with an installation detection process for determining whether the ink cartridge has been mounted and has been mounted at the correct position. That is to say, the printer will detect the ink cartridges one by one and will only determine that the ink cartridge has been mounted and has been mounted at the correct position when the printer acquires corresponding reply signal from the ink cartridge and the light receiver receives equivalent light quantity, and hence the initialization process can be completed; or else, the printer will prompt error. Similarly, as described above, there is problem in the prior art that the ink cartridge is mounted at the correct position but determined to be mounted at a wrong position as the light-emitting portion of the ink cartridge emits light in various degrees due to manufacturing error.

In order to solve the problem in the prior art and satisfy the installation detection process of the ink cartridge, on the basis of the situation that the plurality of light-emitting portions are commonly connected with a line and the read-write control module and the emission control module are independent from each other, the embodiment states: all the control portions of the ink cartridges may turn on the light-emitting portions on the ink cartridges when receiving any emission instruction sent by the printer for controlling all the light-emitting portions to emit light, that is to say, the emission control modules of the ink cartridges in the ink cartridge assembly will control the light-emitting portion to emit lights on the ink cartridges, no matter that the emission instruction sent by the printer corresponds to which ink cartridge in the ink cartridge assembly, namely the plurality of light-emitting portions of the ink cartridge assembly will turned on or off at the same time. The specific operation is as follows: the control portions disposed on different ink cartridges ignore the ink cartridge identifying information included in the emission instruction but directly control the on or off of the light-emitting portions when receiving the emission instruction from the printer. That is to say, no matter which ink cartridge is detected, the plurality of light-emitting portions in the plurality of ink cartridges will be turned on or off at the same time. Properly speaking, no matter which ink cartridge is detected, the control portions will turn on corresponding light-emitting portions as long as the emission instruction sent by the printer is received. That is to say, in the embodiment, the emission control module of each ink cartridge only needs to control the light-emitting portion of the ink cartridge according to the state control information of the light-emitting portion included in the emission instruction and ignores the ink cartridge identifying information included in the emission instruction. That is to say, in the embodiment, the emission control module and the read-write control module are independent from each other.

Figure 5:
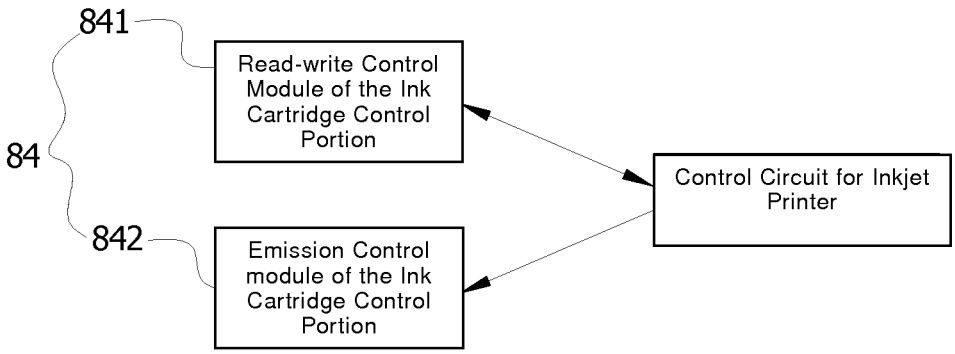
FIG. 5 is a schematic diagram illustrating the communication between the ink cartridge and the control circuit of the printer according to the embodiment of the present invention.

Obviously, by adopting the emission control method of the light-emitting portion, the emission control module and the printer are only subjected to one-way communication, namely the emission control module only needs to control the on or off of the light-emitting portion by receiving the instruction of the printer and does not need to return relevant information to the printer, and the action of returning a reply signal to the printer is executed by the read-write control module. FIG. 5 is a schematic diagram illustrating the communication between a controller in the embodiment and the printer. Moreover, the read-write control module may also receive and respond to a read-write instruction sent by the printer so as to allow the printer to perform read-write operation on the chip of the ink cartridge.

In the embodiment, the ink cartridge identifying information is color ID set based on different colors ink filled into the ink cartridges.

As illustrated in FIG. 3*a*, the format of the instruction sent by the control circuit of the printer for controlling the light-emitting portion to emit light is as follows: color ID (or type identifier) code+state (e.g., ON, OFF, caLL) code. For instance, supposing the ink cartridges A and B respectively represent a black ink cartridge (K) and a yellow ink cartridge (Y), codes of the ink cartridges A and B are respectively 110 and 101 and codes of ON and OFF are respectively 000 and 100, instructions "110000", "110100", "101000" and "101100" respectively indicate "the ink cartridge A is turned on", "the ink cartridge A is turned off", "the ink cartridge B is turned on" and "the ink cartridge B is turned off". As described above, in the embodiment, the emission control module of the control portion ignores the color ID code, namely the emission control module of the control portion will not send a response signal to the control circuit but directly drives the light-emitting portion (LED lamp) to emit light no matter the received instruction is "the ink cartridge A is turned on" or t "the ink cartridge B is turned on". That is to say, in the present invention, the emission control module analyzes the information sent by the control circuit of the printer as shown in FIG. 3*b*, namely completely ignores the color ID represented by the previous three bits and only controls the LED lamp according to the state code of the LED lamp represented by the posterior three bits. Similarly, the method of controlling the off of the light-emitting portion is also similar. Therefore, after the ink cartridge adopts the above emission control method, the emission control module only needs to turn on or off the light-emitting portion according to the state information of the light-emitting portion included in the emission instruction. However, if no reply signal is returned to the printer, the control circuit of the printer will determine that the ink cartridge is not mounted and hence the initialization process cannot be completed. Therefore, in the technical proposal, the read-write control module not only needs to control the read-write operation in the chip read-write stage but also needs to return the reply signal to the printer in the installation detection stage according to the ink cartridge installation reply instruction of the printer.

Figure 6:
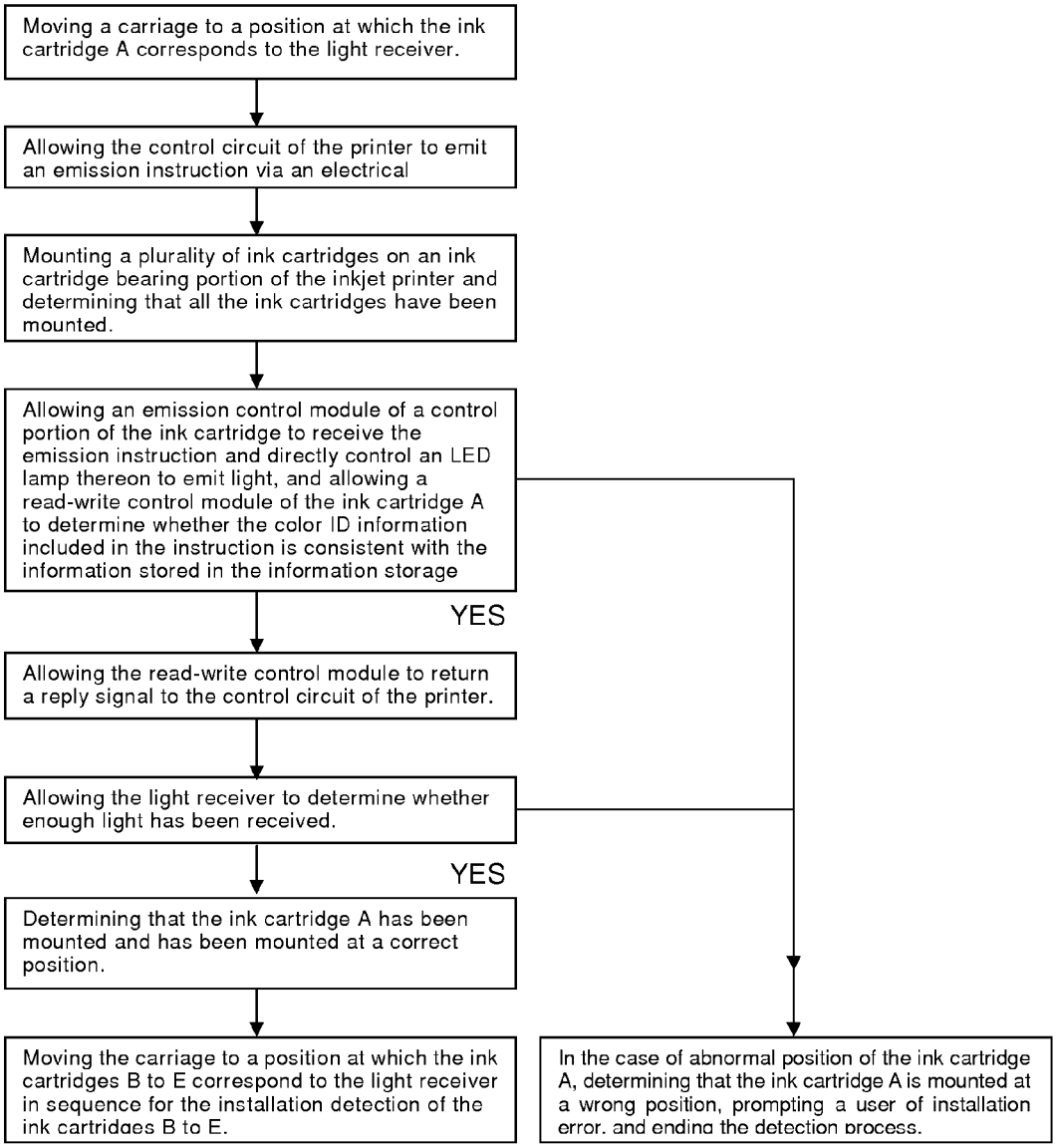
FIG. 6 is a schematic diagram illustrating the installation detection process of the ink cartridge assembly provided by the embodiment of the present invention.

FIGS. 4*a* to 4*d* are schematic diagrams illustrating the installation detection of the ink cartridge assembly in the embodiment. FIG. 6 is a flowchart illustrating the installation detection process of the ink cartridge assembly in the embodiment.

1. The ink cartridge assembly comprising the plurality of ink cartridges is mounted on the inkjet printer.

2. The inkjet printer sends ink cartridge installation reply instructions specific to the plurality of ink cartridges in sequence; and correspondingly, the read-write control modules of the plurality of ink cartridges return reply signals to the printer in sequence to indicate that the ink cartridges have been mounted; if certain reply instruction has no reply signal, it indicates that certain ink cartridge is not mounted; and hence the printer stops detection and prompts a user to mount the ink cartridge.

3. After the printer determined that all the ink cartridges have been mounted, the carriage is driven by a motor of the printer to drive the ink cartridges disposed thereon to move back and forth, and stop moving when moved to a position at which the ink cartridge a corresponds to the light receiver.

Figure 4A:
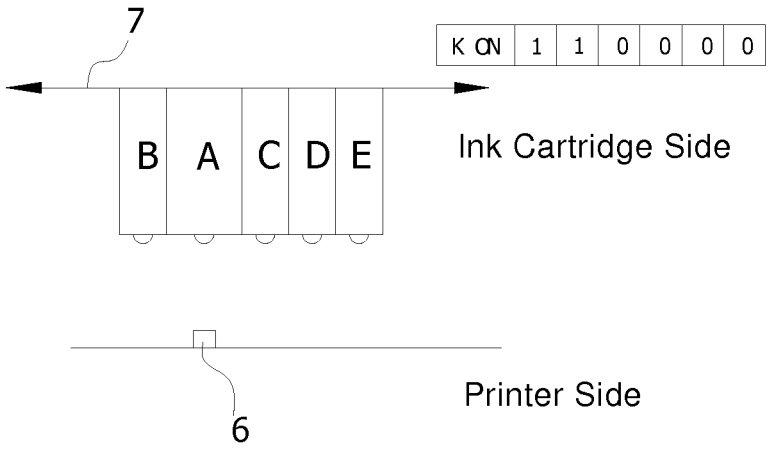
FIGS. 4*a* to 4*d* are schematic diagrams illustrating the installation detection process of an ink cartridge assembly in the embodiment of the present invention.
Figure 4B:
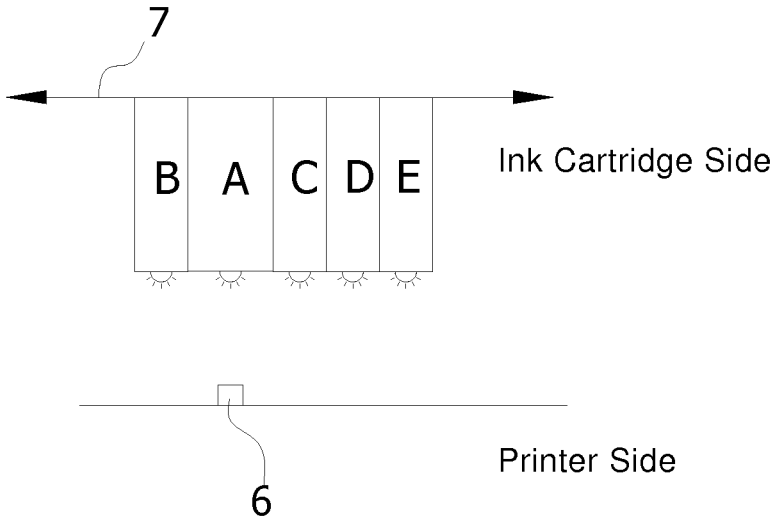

4. As illustrated in FIG. 4*a*, when the control circuit of the printer sends an emission instruction for controlling the ink cartridge A, the emission control modules of the control portions of the ink cartridges A to E acquire the emission instruction through the electrical conductor and directly control the light-emitting portion to emit lights of the ink cartridges to emit light according to the emission instruction. In the embodiment, the light-emitting portions are LED lamps, as illustrated in FIG. 4*b*.

5. At this moment, the light receiver determines whether the received light is enough or not; when the light quantity of the light received by the light receiver is greater than a threshold, the control circuit determines that the ink cartridge A has been mounted and has been mounted at the correct position; or else, when the light quantity of the light received by the light receiver is less than the threshold, the control circuit will determine that the ink cartridge a is not mounted or has been mounted but has not been mounted at the correct position, prompt an error, and end the detection process.

Figure 4C:
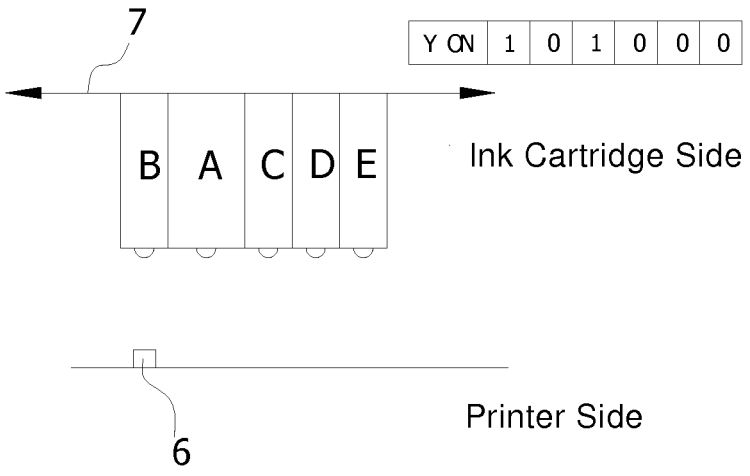
Figure 4D:
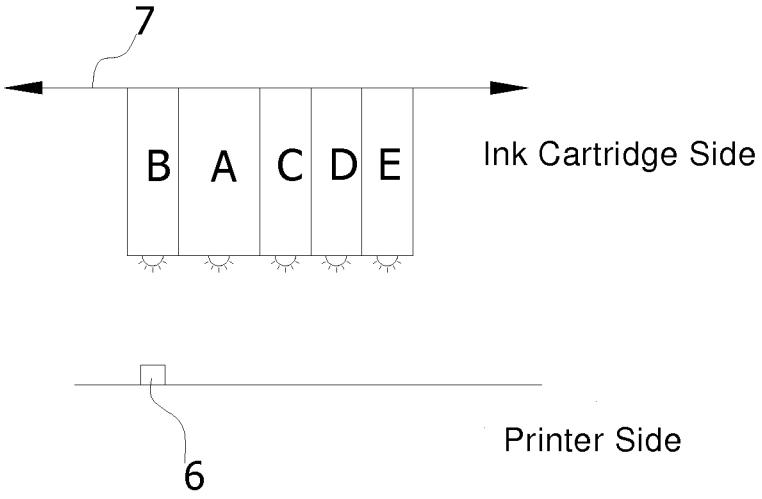

6. Subsequently, as illustrated in FIG. 4*c*, the printer drives the carriage to move forwards until the position of the ink cartridge B corresponds to the light receiver; when the carriage is moved to the position at which the ink cartridge B corresponds to the light receiver, the control circuit sends an emission instruction for controlling the ink cartridge B; similarly, the emission control modules of the control portions of the ink cartridges A, C, D and E acquire the emission instruction and directly control the LED lamps disposed on the ink cartridges to emit light (as shown in FIG. 4*d*); when the light quantity of the light received by the light receiver is greater than the threshold, the control circuit determines that the ink cartridge has been mounted and has been mounted at the correct position; or else, the control circuit determines that the ink cartridge is mounted at a wrong position.

7. The above steps are repeated until that the ink cartridges C, D and E are determined to be mounted at correct positions is detected, and hence the detection process ends.

Obviously, as known from the implementation, the plurality of LED lamps in the ink cartridge assembly will be turned on or off no matter the emission instruction sent by the printer controls the on or off of which ink cartridge in the ink cartridge assembly. That is to say, the control portions (emission control modules) of the ink cartridges in the ink cartridge assembly will respectively control respective light-emitting portions to emit light when receiving any emission instruction sent by the printer. In this case, in the installation detection process, even if the luminous brightness of certain LED lamp is relatively low, scattered light emitted by LED lamps of adjacent ink cartridges may be replenished to a certain degree, and hence the light quantity can satisfy the light quantity threshold required by detection, and hence the phenomenon that the ink cartridge is mounted at the correct position obviously but the printer determines that the ink cartridge is not mounted at the correct position due to low light quantity of the LED lamp can be avoided.

In summary, the above technical proposal can fully guarantee the stability of the ink cartridge installation detection and avoid the phenomenon of the installation detection error of the ink cartridge caused by the manufacturing error of the LED lamp.

Embodiment 2

The present invention is provided with an ink cartridge installation detection module. The ink cartridge installation detection module is detachably connected with an ink cartridge assembly body or an ink cartridge body. The ink cartridge installation detection module is communicated with an inkjet recording apparatus via a line. In the initialization process of the inkjet recording apparatus, the ink cartridge installation detection module replaces specific ink cartridges to respond to all or partial instructions, relevant to the ink cartridge installation detection, sent by the inkjet recording apparatus, so that the present invention not only satisfies the inherent ink cartridge installation detection requirement of the inkjet recording apparatus but also allows ink cartridges without the ability of responding to the installation detection relevant instructions to be adapted to the inkjet recording apparatus. Therefore, the universality of the ink cartridges can be improved; the selection range of ink cartridges adapted to the inkjet recording apparatus can be widened; and the use cost of the users can be reduced. Moreover, as the ink cartridge installation detection module may be reutilized, the resource utilization can be improved and the cost can be reduced.

More specifically, for more clear description of the technical proposal, symbol marks or noun descriptions different from those of the embodiment 1 may be adopted in the embodiment. For instance, a plurality of ink cartridges may be represented by a to e respectively, but a to e indicate the same meaning and are only used for distinguishing the structure of different embodiments.

The inkjet recording apparatus in the embodiment may specifically be an inkjet printer, an inkjet facsimile machine, an inkjet duplicator or the like. The inkjet recording apparatus may include an inkjet recording apparatus body and an ink cartridge assembly; and the ink cartridge assembly is detachably mounted on the inkjet recording apparatus body.

The inkjet recording apparatus body may include a control circuit, a light receiver and a carriage. The control circuit is configured to integrally control the working process of the inkjet recording apparatus; the light receiver is connected with the control circuit and configured to receive light in the ink cartridge installation detection process; and the carriage is configured to move with accommodating the ink cartridge assembly so as to guarantee that the ink cartridges on the ink cartridge assembly can be moved to a position relative to the light receiver one by one.

The ink cartridge assembly is detachably mounted on the carriage and electrically connected with the control circuit. The ink cartridge assembly may include an ink cartridge assembly body and an ink cartridge installation detection module 22 detachably mounted on the ink cartridge assembly body.

The ink cartridge assembly body includes at least two ink cartridges detachably mounted in a housing. The ink cartridge installation detection module 22 and the ink cartridges are communicated with the control circuit of the inkjet recording apparatus body via a line.

Figure 7:
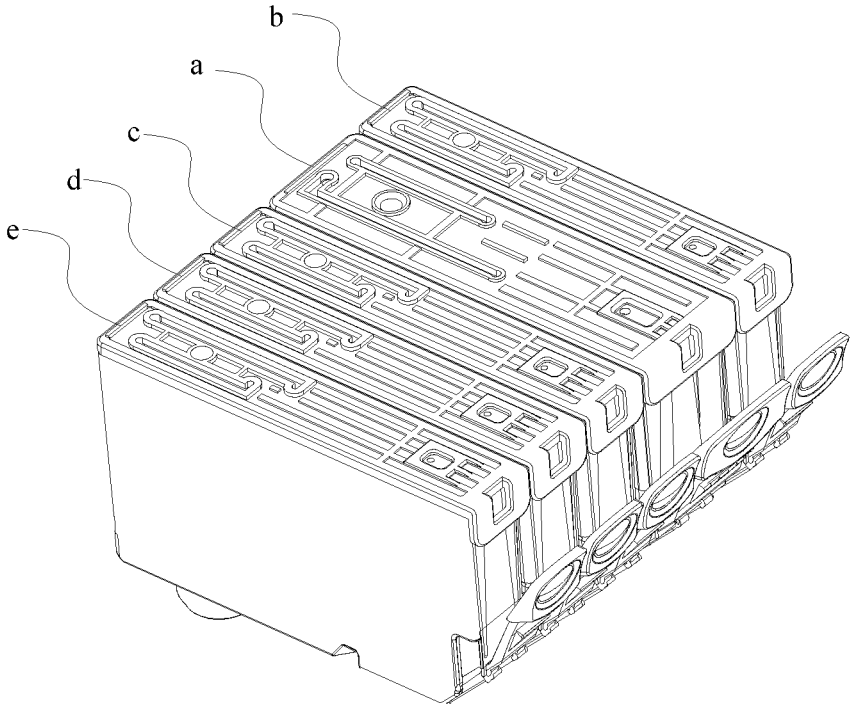
FIG. 7 is a schematic structural view of an ink cartridge assembly body provided by another embodiment of the present invention.
Figure 8:
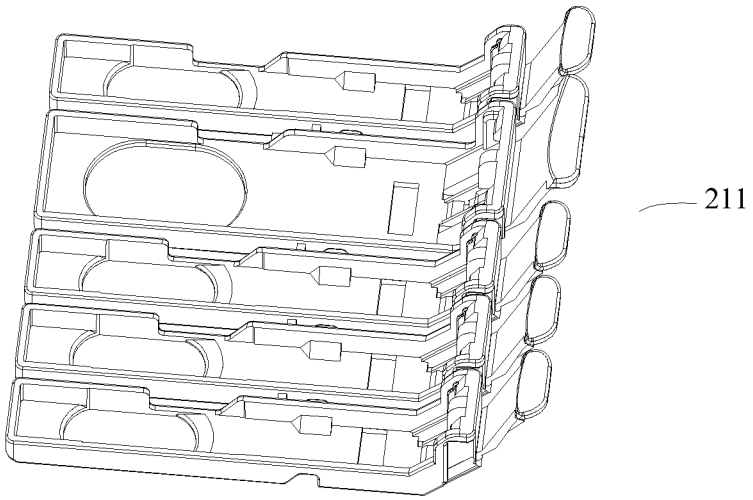
FIG. 8 is a schematic structural view of a housing of the ink cartridge assembly body provided by another embodiment of the present invention.
Figure 9:
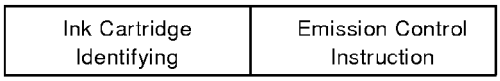
FIG. 9 is a structure example of an ink cartridge installation detection instruction provided by another embodiment of the present invention.

As shown in FIG. 7, an optional structure of the ink cartridge assembly body may include a housing 211 and 5 ink cartridges detachably mounted in the housing 211. The 5 ink cartridges may be represented by an ink cartridge a, an ink cartridge b, an ink cartridge c, an ink cartridge d and an ink cartridge e. As shown in FIG. 8, the structure of the housing 211 includes accommodating areas of the 5 ink cartridges; and the ink cartridges a to e are respectively, correspondingly and detachably mounted in the accommodating areas of the ink cartridges. The specification of different ink cartridges may be same or different.

Figure 10:
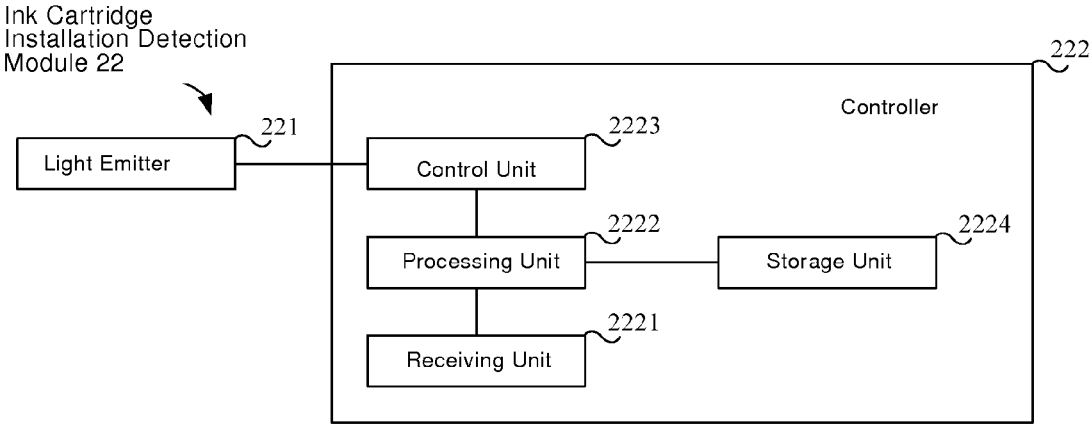
FIG. 10 is a schematic structural view of an ink cartridge installation detection module provided by another embodiment of the present invention.

As illustrated in FIG. 10, the structure of the ink cartridge installation detection module 22 includes a light-emitting portion 221 and a control portion 222 which are connected with each other.

The light-emitting portion 221 is configured to provide a light source. As the same with the embodiment 1, the light source may be a visible light source or an invisible light source.

In the embodiment, the control portion 222 is configured to receive a plurality of ink cartridge installation detection instructions sent by the inkjet recording apparatus via a line, analyze the ink cartridge installation detection instructions, and turn on or off the light-emitting portion according to the analytic result of a processing unit. It should be understood by those skilled in the art that the ink cartridge installation detection instruction in the embodiment has the same meaning with the emission instruction in the embodiment 1 and refers to an instruction, for controlling the on or off of the light-emitting portion of the ink cartridge, sent by the inkjet printer.

The control portion 222 may include a receiving unit 2221, a processing unit 2222 and a control unit 2223.

The receiving unit 2221 may be configured to receive the plurality of ink cartridge installation detection instructions sent by the inkjet recording apparatus via a line. The ink cartridge installation detection instruction includes an emission control instruction and ink cartridge identifying information; the ink cartridge identifying information corresponds to an ink cartridge which must respond to the emission control instruction; and the emission control instruction includes an on instruction or an off instruction. It should be understood by those skilled in the art that the emission control instruction and the ink cartridge identifying information in the embodiment and the state control information of the light-emitting portion and the ink cartridge identifying information in the embodiment 1 are all codes for controlling the state of the light-emitting portion and codes for distinguishing the ink cartridges.

The processing unit 2222 may be configured to analyze the ink cartridge installation detection instruction.

The control unit 2223 may be configured to turn on or off the light-emitting portion according to the analytic result of the processing unit.

In addition, the control portion 222 further includes a storage unit 2224 which may be configured to store a quantity of ink cartridge identifying information.

The receiving unit 2221 is also configured to receive an ink cartridge installation reply request sent by the inkjet recording apparatus before receiving the ink cartridge installation detection instruction. The ink cartridge installation reply request includes ink cartridge identifying information of an ink cartridge which must respond to the ink cartridge installation reply request.

The processing unit 2222 is also configured to compare the ink cartridge identifying information in the ink cartridge installation reply request with default identifying information.

The control unit 2223 is also configured to send an ink cartridge installation reply response to the inkjet recording apparatus if the comparison result indicates that the default identifying information includes the ink cartridge identifying information in the ink cartridge installation reply request.

The storage unit may be a storage medium, e.g. ROM and FLASH; or the storage unit may be integrated into a logical operation circuit with other unit of the control portion, e.g., the processing unit.

The method for detecting the installation of the ink cartridge via the ink cartridge installation detection module 22 is, for instance, as follows: receiving the plurality of ink cartridge installation detection instructions sent by the inkjet recording apparatus via the line; analyzing the ink cartridge installation detection instructions; and turning on or off the light-emitting portion according to the analytic result.

In the embodiment, each ink cartridge may include an ink cartridge body and an ink cartridge chip. The ink cartridge chips of the ink cartridges and the ink cartridge installation detection module may be communicated with the control circuit via a line.

Figure 11:
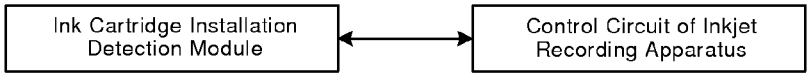
FIG. 11 is a schematic diagram illustrating the method of information interaction between the ink cartridge installation detection module provided by another embodiment of the present invention and a control circuit of an inkjet recording apparatus.

In the embodiment, as the default ink cartridge information is stored in the ink cartridge installation detection module, the ink cartridge installation detection module may also replace the ink cartridge to perform response processing on the installation reply process apart from performing reply processing on the emission detection process. In this case, the two-way interaction between the ink cartridge installation detection module and the control circuit of the inkjet recording apparatus is involved in the ink cartridge installation detection process. An example of the interactive method is as shown in FIG. 11.

Figure 12A:
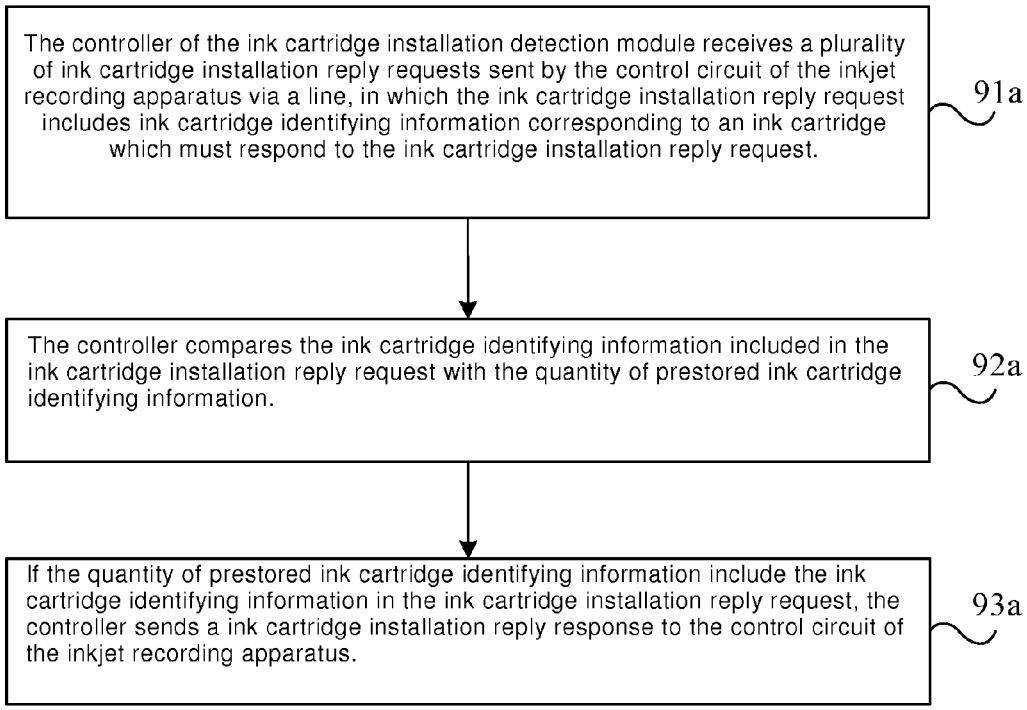
FIG. 12*a* is a schematic diagram illustrating the installation reply process in the ink cartridge installation detection process provided by another embodiment of the present invention.

More specifically, the principle of the ink cartridge installation detection module in performing the installation reply response processing is, as illustrated in FIG. 12*a*, as follows:

Step 91*a*: the control portion of the ink cartridge installation detection module receives a plurality of ink cartridge installation reply requests sent by the control circuit of the inkjet recording apparatus via a line. Each ink cartridge installation reply request includes ink cartridge identifying information corresponding to an ink cartridge which must respond to the ink cartridge installation reply request.

The ink cartridge identifying information is any identifying information of the ink cartridge which must respond to the ink cartridge installation reply request, e.g., the ink cartridge ID, the ink color identifier of the ink cartridge and the type identifier of the ink cartridge.

Step 92*a*: the control portion compares the ink cartridge identifying information in the ink cartridge installation reply request with a plurality of prestored ink cartridge identifying information.

In actual application, the ink cartridge identifying information of the ink cartridges in the ink cartridge assembly may be taken as the default identifying information.

Step 93*a*: the control portion sends an ink cartridge installation reply response to the control circuit of the inkjet recording apparatus if the plurality of prestored ink cartridge identifying information includes the ink cartridge identifying information in the ink cartridge installation reply request.

As illustrated in FIG. 7, the default identifying information may be the respective ink cartridge identifying information of the 5 ink cartridges, namely the ink cartridges a to e. The ink cartridge identifying information in the ink cartridge installation reply request sent by the control circuit may be the respective ink cartridge identifying information of the 5 ink cartridges, namely the ink cartridges a to e. In the prior art, the 5 ink cartridges respectively respond to the ink cartridge installation reply request; and the ink cartridge will send an ink cartridge installation reply response to the control circuit only when the ink cartridge identifying information in the ink cartridge installation reply request includes the ink cartridge identifying information of the ink cartridge. In the embodiment, the ink cartridge installation detection module is configured to make a unified response to the ink cartridge installation reply requests; and the response trigger condition is that: the ink cartridge installation detection module will send the ink cartridge installation reply response to the control circuit as long as the default identifying information includes the ink cartridge identifying information in the ink cartridge installation reply request.

The inkjet recording apparatus continues to execute the emission detection process when receiving the ink cartridge installation reply responses corresponding to the ink cartridge identifying information in the ink cartridge installation reply requests, or else, outputs error information and does not continue to execute the emission detection process.

In the embodiment, the emission detection process is specifically as follows: the processing unit 2222 may be specifically configured to acquire the ink cartridge identifying information and the emission control instruction in the ink cartridge installation detection instruction, compare the ink cartridge installation detection instruction with the quantity of ink cartridge identifying information stored in the storage unit one by one, and obtain a comparison result; and the control unit 2223 may be specifically configured to turn on or off the light-emitting portion when the quantity of ink cartridge identifying information stored in the storage unit include the ink cartridge identifying information in the ink cartridge installation detection instruction.

When the number of the light-emitting portions is numerous, optionally, the storage unit 2224 is also configured to store mapping relationships between the plurality of light-emitting portions and the quantity of ink cartridge identifying information; and the control unit 2223 is specifically configured to turn on or off the light-emitting portion corresponding to the ink cartridge identifying information in the ink cartridge installation detection instruction according to the emission control instruction and the mapping relationship when the comparison result indicates that the quantity of ink cartridge identifying information stored in the storage unit include the ink cartridge identifying information in the ink cartridge installation detection instruction.

Figure 12B:
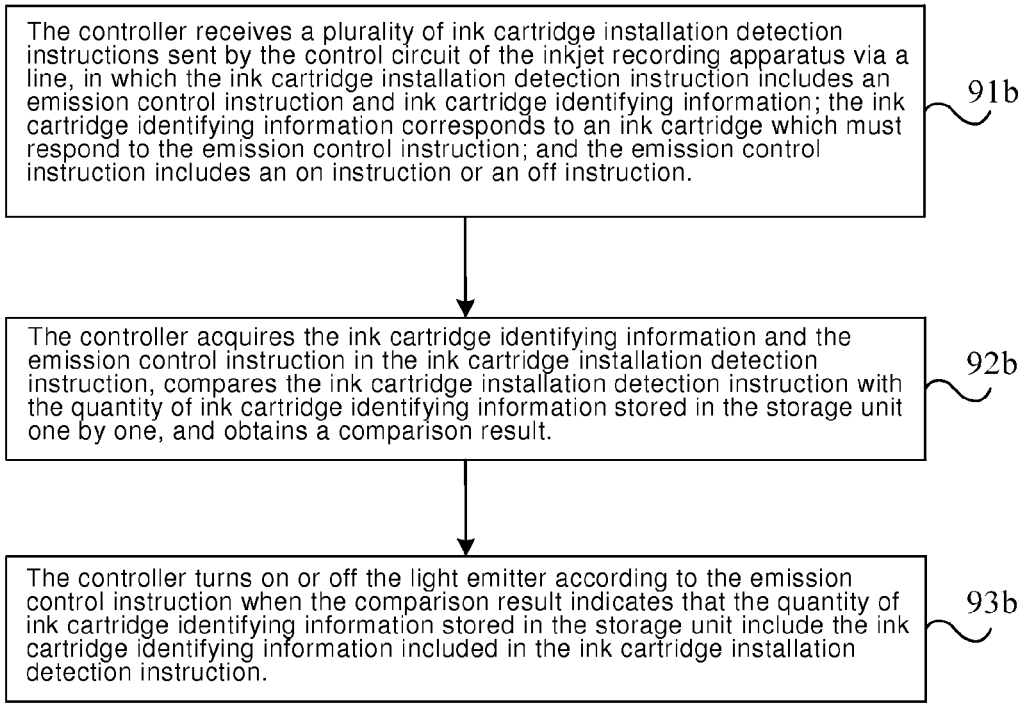
FIG. 12*b* is a schematic diagram illustrating the emission detection process in the ink cartridge installation detection process provided by another embodiment of the present invention.

In the replaceable optional proposal, the principle of the ink cartridge installation detection module in processing the emission detection process is, as shown in FIG. 12*b*, as follows:

Step 91*b*: the control portion receives the plurality of ink cartridge installation detection instructions sent by the control circuit of the inkjet recording apparatus via a line. Each ink cartridge installation detection instruction includes an emission control instruction and ink cartridge identifying information; the ink cartridge identifying information corresponds to an ink cartridge which must respond to the emission control instruction; and the emission control instruction includes an on instruction or an off instruction.

Step 92*b*: the control portion acquires the ink cartridge identifying information and the emission control instruction in the ink cartridge installation detection instruction, compares the ink cartridge identifying information in the ink cartridge installation detection instruction with the quantity of ink cartridge identifying information stored in the storage unit one by one, and obtains a comparison result.

Step 93*b*: the control portion turns on or off the light-emitting portion according to the emission control instruction when the comparison result indicates that the quantity of ink cartridge identifying information stored in the storage unit include the ink cartridge identifying information in the ink cartridge installation detection instruction.

If the emission control instruction is an on instruction, the control portion turns on the light-emitting portion; and if the emission control instruction is an off instruction, the control portion turns off the light-emitting portion.

The control portion repeats the above steps 92*b* and 93*b* when receiving the ink cartridge installation detection instruction each time.

Optionally, the number of the light-emitting portion may be one or more. When the number of the light-emitting portions is numerous, the control portion may prestore mapping relationships between the plurality of light-emitting portions and the quantity of ink cartridge identifying information, and turn on or off the light-emitting portion corresponding to the ink cartridge identifying information in the ink cartridge installation detection instruction according to the emission control instruction and the mapping relationship when the comparison result indicates that the quantity of ink cartridge identifying information stored in the storage unit include the ink cartridge identifying information in the ink cartridge installation detection instruction.

As known from the above analysis, the embodiment does not need to change the installation detection process of the inkjet recording apparatus but adopts the ink cartridge installation detection module to replace the ink cartridge to respond to the whole the ink cartridge installation detection process, so that the embodiment not only satisfies the inherent ink cartridge installation detection requirement of the inkjet recording apparatus but also allows ink cartridges without the ability of responding the installation detection relevant instructions to be adapted to the inkjet recording apparatus. Therefore, the universality of the ink cartridges can be improved; the selection range of ink cartridges adapted to the inkjet recording apparatus can be widened; and the use cost of the users can be reduced. Moreover, as the ink cartridge installation detection module may be reutilized, the resource utilization can be improved and the cost can be reduced.

In addition, it should be understood by those skilled in that as for a single ink cartridge, the ink cartridge may include an ink cartridge body and an ink cartridge chip, and the ink cartridge installation detection module is detachably mounted on the ink cartridge body; or the ink cartridge installation detection module and the ink cartridge chip are integrated into a whole and detachably mounted on the ink cartridge body. As the ink cartridge is provided with the ink cartridge installation detection module, the universality of the ink cartridges can be improved. Moreover, as the ink cartridge installation detection module can be reutilized, the production efficiency of the ink cartridges can be improved and the production cost of the ink cartridges and the use cost of the users can be reduced.

Figure 13:
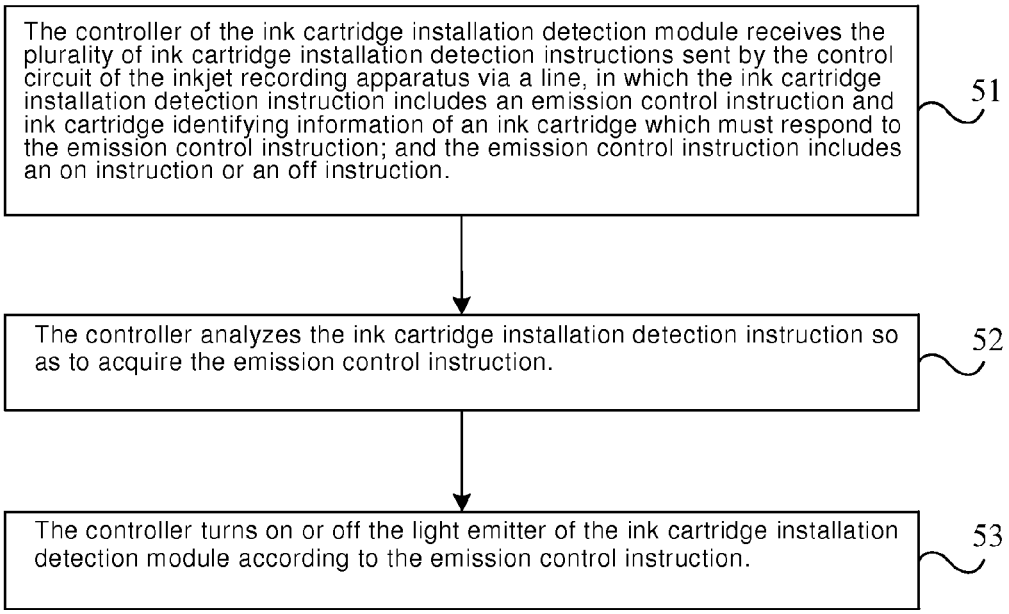
FIG. 13 is a schematic diagram illustrating the emission detection process in the ink cartridge installation detection process of another ink cartridge installation detection module provided by another embodiment of the present invention.

Moreover, it should be understood by those skilled in that the ink cartridge installation detection module may also be not provided with a storage unit but only includes a receiving unit, a processing unit and a control unit. By adoption of the structure, the processing unit may ignore the ink cartridge identifying information included in the ink cartridge installation detection instruction in the process of analyzing the ink cartridge installation detection instruction; and the control unit only turns on or off the light-emitting portion according to the emission control instruction. FIG. 13 is a flowchart illustrating the specific installation detection process. When the number of the light-emitting portions is numerous, the control unit 2223 may be specifically configured to turn on or off the plurality of light-emitting portions at the same time according to the comparison result of the processing unit or the acquired emission control instruction. At this moment, the installation reply response processing process is processed by the ink cartridge chip. More specifically, the ink cartridge chips receive the ink cartridge identifying information, determine whether the received ink cartridge identifying information is self ink cartridge identifying information, send ink cartridge installation reply responses to the inkjet recording apparatus if so, and do not send the ink cartridge installation reply responses if not.

In addition, the embodiment further provides an ink cartridge assembly. In the ink cartridge assembly, an ink cartridge installation detection module may be integrated into a whole with an ink cartridge chip of any ink cartridge and other ink cartridges are only provided with ink cartridge chips.

In the above embodiments, the description of respective embodiments has emphasis, and parts without detailed description in certain embodiment may refer to relevant description of other embodiments.

Moreover, functional units in the embodiments of the present invention may be integrated in a unit and may also exist independently and physically; or two or more than two functional units are integrated in a unit. The integrated unit may be implemented by means of hardware and may also be implemented by means of a hardware and software functional unit.

It should be understood by those skilled in the art that: all or partial steps for implementing the method embodiments may be completed by hardware relevant to program instructions. The foregoing program may be stored in a computer-readable storage medium. The program executes the steps of the method embodiments in the process of execution. The foregoing storage medium includes various media capable of storing program codes, e.g., ROM, RAM, disc and CD.

It should be finally noted that the foregoing embodiments are only illustrative of the technical proposals of the present invention and not intended to limit the present invention. Although detailed description has been given to the present invention with reference to the foregoing embodiments, it should be understood by those skilled in the art that: modification may be still made to the technical proposals of the foregoing embodiments and equivalent replacement may be still made to partial or all the technical characteristics therein, by those skilled in the art; and the modifications or replacements should not allow the essence of corresponding technical proposals to depart from the scope of the technical proposals of the embodiments of the present invention.

What is claimed is:

1. An ink cartridge detachably mountable to an inkjet recording apparatus having a light receiver for receiving light, the ink cartridge comprising:

a light emitting portion configured to emit light towards the light receiver; and a control portion configured to:

store a plurality of identifiers with ink cartridge identifying information corresponding to the ink cartridge and one or more different ink cartridges;

receive an ink cartridge installation detection instruction sent by the inkjet recording apparatus via a connection line, wherein the ink cartridge installation detection instruction includes an emission control instruction and ink cartridge identifying information;

determine whether the ink cartridge identifying information included in the ink cartridge installation detection instruction matches any of the plurality of identifiers stored in the control portion;

when the ink cartridge identifying information included in the ink cartridge installation detection instruction matches any of the plurality of identifiers stored in the control portion, control the light emitting portion to emit light towards the light receiver of the inkjet recording apparatus.

2. The ink cartridge according to claim 1, wherein the control portion is further configured to:

in response to the ink cartridge installation detection instruction, send an ink cartridge installation reply response to the inkjet recording apparatus.

3. The ink cartridge according to claim 1, wherein the control portion further includes:

a storage unit configured to store the plurality of identifiers;

a receiving unit configured to receive the ink cartridge installation detection instruction from the inkjet recording apparatus;

a processing unit configured to acquire the ink cartridge identifying information and the emission control instruction in the ink cartridge installation detection instruction, and to determine whether the ink cartridge identifying information included in the ink cartridge installation detection instruction matches any of the plurality of identifiers stored in the control portion; and the control unit is configured to control the light emitting portion to turn on or off the light based on whether the ink cartridge identifying information included in the ink cartridge installation detection instruction matches any of the plurality of identifiers stored in the control portion.

4. The ink cartridge according to claim 1, wherein the ink cartridge further comprises an ink cartridge chip, and the control portion is integrated with the cartridge chip.

5. The ink cartridge according to claim 1, wherein the control portion is further configured to:

receive multiple ink cartridge installation detection instructions with different ink cartridge identifying information from the inkjet recording apparatus;

ignore the ink cartridge identifying information in the ink cartridge installation detection instructions; and control the light emitting portion based on the emission control instruction in each of the multiple ink cartridge installation detection instructions.

6. A control method for an ink cartridge detachably mountable to an inkjet recording apparatus having a light receiver for receiving light, wherein the ink cartridge comprises a light emitting portion configured to emit light towards the light receiver and a control portion, the method comprising:

storing a plurality of identifiers with ink cartridge identifying information corresponding to the ink cartridge and one or more different ink cartridges;

receiving an ink cartridge installation detection instruction sent by the inkjet recording apparatus via a connection line, wherein the ink cartridge installation detection instruction includes an emission control instruction and ink cartridge identifying information;

determining whether the ink cartridge identifying information included in the ink cartridge installation detection instruction matches any of the plurality of identifiers stored in the control portion; and when the ink cartridge identifying information included in the ink cartridge installation detection instruction matches any of the plurality of identifiers stored in the control portion, controlling the light emitting portion to emit light towards the light receiver of the inkjet recording apparatus.

7. The method according to claim 6, further including:

in response to the ink cartridge installation detection instruction, sending an ink cartridge installation reply response to the inkjet recording apparatus.

8. The method according to claim 6, wherein the controlling the light emitting portion further includes:

controlling the light emitting portion to turn on or off the light based on whether the ink cartridge identifying information included in the ink cartridge installation detection instruction matches any of the plurality of identifiers stored in the control portion.

9. The method according to claim 6, wherein the ink cartridge further comprises an ink cartridge chip, and the control portion is integrated with the cartridge chip.

10. The method according to claim 6, further including:

receiving multiple ink cartridge installation detection instructions with different ink cartridge identifying information from the inkjet recording apparatus;

ignoring the ink cartridge identifying information in the ink cartridge installation detection instructions; and controlling the light emitting portion based on the emission control instruction in each of the multiple ink cartridge installation detection instructions.

* * * * *